United States Patent [19]

Carter

[11] Patent Number: 4,709,186

[45] Date of Patent: Nov. 24, 1987

[54] COUPLED CAVITY TRAVELLING WAVE TUBES

[75] Inventor: Richard G. Carter, Carnforth, England

[73] Assignee: English Electric Valve Company Limited, Chelmsford, England

[21] Appl. No.: 817,782

[22] Filed: Jan. 10, 1986

[51] Int. Cl.[4] ..... H01J 25/34

[52] U.S. Cl. ..... 315/3.5; 315/3.6

[58] Field of Search ..... 315/3.5, 3.6; 333/156, 333/157

[56] References Cited

U.S. PATENT DOCUMENTS

| | | | |
|---|---|---|---|
| 3,602,766 | 8/1971 | Grant | 315/3.6 |
| 4,066,927 | 1/1978 | Gross | 315/3.6 |
| 4,143,341 | 3/1979 | Gross | 315/3.6 |
| 4,158,154 | 6/1979 | Gross | 315/3.6 |

FOREIGN PATENT DOCUMENTS

| | | | |
|---|---|---|---|
| 753999 | 9/1956 | United Kingdom | 315/3.5 |
| 879997 | 2/1961 | United Kingdom | 315/3.5 |

*Primary Examiner*—David K. Moore
*Assistant Examiner*—Mark R. Powell
*Attorney, Agent, or Firm*—Spencer & Frank

[57] ABSTRACT

A coupled cavity travelling wave tube of the space harmonic type is provided wherein the interaction gaps in successive cavities are alternately offset towards the input end of the slow wave structure and towards the output of the slow wave structure, whereby beam electrons which are synchronous at band edge frequencies tend to experience a phase reversal in the electro-magnetic wave propagating in the slow wave structure, at each successive interaction gap.

4 Claims, 6 Drawing Figures

COUPLED CAVITY TRAVELLING WAVE TUBES

BACKGROUND OF THE INVENTION

This invention relates to coupled cavity travelling wave tubes.

A typical coupled cavity travelling wave tube as at present known will be described with reference to FIG. 1 of the accompanying drawings which represents a longitudinal section through the slow wave structure of the tube.

The slow wave structure consists of a generally cylindrical tube 1 which is divided by partitions such as 2, 3, 4 and 5 into a series of cavities such as 6, 7 and 8.

Along the axis 9 of the tube a beam-hole is provided in each partition 2, 3, 4 and 5 so as to permit the passage of an electron beam from the input end 10 of the slow wave structure to the outward end 11 of the slow wave structure. Each beam hole is surrounded by a drift tube referenced 12, 13, 14 and 15 respectively in the case of the beam holes in the partitions 2, 3, 4 and 5. Between the end of one drift tube and the beginning of the next drift tube along the axis of the tube is an interaction gap referenced 16 in the case of the interaction gap between drift tubes 12 and 13; 17 in the case of the interaction gap between the drift tubes 13 and 14; and 18 in the case of the interaction gap between the drift tubes 14 and 15. As shown the interaction gaps 16, 17 and 18 are disposed symmetrically about the transverse central plane of the respective cavity 6, 7 and 8.

The electron beam 19 passed in operation along the axis 9 of the slow wave structure in the direction of the arrow is, as represented, cylindrical in cross-section. Ihis electron beam interacts with the electric field of an electro-magnetic wave which is propagated along the structure with a phase velocity approximately equal to the velocity of the electrons in the beam 19. The series of cavities such as 6, 7 and 8, resonant at microwave frequencies, are inter-connected such that the phase shift between adjacent cavities is determined by the frequency of the aforementioned electro-magnetic wave. The use of short drift tubes such as 12, 13, 14 and 15 separated by interaction gaps 16, 17 and 18 is to maximise the interaction between the electron beam and the electro-magnetic wave propagating along the structure. This form of coupled cavity travelling wave tube is commonly referred to as a "space harmonic" tube.

Although with this example, and as mentioned, each interaction gap is symmetrically disposed about the transverse central plane of its cavity, it is known to offset the interaction gaps towards the output end of the tube with the object of compensating for the reduction in the mean velocity of the electron beam in that region.

The type of slow wave structure illustrated in FIG. 1 acts as a bandpass filter whose characteristics may be represented by a dispersion diagram as shown in FIG. 2 of the accompanying drawings. This diagram shows the relationship between the frequency of the signal and the phase shift per cavity. Because the slow wave structure is periodic in space the diagram is repeated periodically in the horizontal direction. The reason for this is that the electrons of the beam respond to the instantaneous phase of the electric field as they pass through the interaction gaps and the electrons are indifferent to changes of phase by integral multiples of 360°. FIG. 2 also shows a line representing the velocity of the electrons in the beam. It will be seen that the aforementioned line lies close to the dispersion curve over an appreciable band of frequencies in the second space harmonic of the electro-magnetic wave on the structure. Over this band of frequencies the interaction between the electrons in the beam and the electro-magnetic wave results in a net transfer of energy from the beam to the wave with resultant r.f gain.

The operation of the tube may be understood by considering an electron which passes through the center A of interaction gap 16 in FIG. 1 at the moment when the field in the gap is at a maximum and tending to accelerate the electron. If the frequency of the wave on the structure is such that the wave is synchronous with the velocity of the electrons as shown in FIG. 2 then the field in interaction gap 17 will also be a maximum in the forward direction when the electron reaches the center B of interaction gap 17. Conversely, an electron which passes through the center B ofinteraction gap 16 when the field is maximum and retarding will be progressively slowed down. This process ensures that the electrons tend to become bunched as they travel down the tube with the faster electrons tending to catch up with the slower electrons. These bunches induce currents in the cavities losing energy in the process and this energy is transferred to the electromagnetic wave on the structure.

The strength of the interaction between the electron beam and the slow wave structure is not uniform across the passband of the structure. In particular it varies inversely with the group velocity of the wave on the structure and therefore tends to very large values at the band edges. The strong interaction between the beam and the structure at the band edges can result in oscillations close to the band edge frequencies. Not only are such oscillations a source of unwanted r.f output from the tube but also in some cases such oscillations can generate sufficient power to destroy the tube. Commonly such oscillations are encountered at the upper cut off frequency of the structure where the phase shift per cavity is 360°.

One object of the present invention is to provide an improved coupled cavity travelling wave tube in which the tendency to oscillate at the band edge is reduced.

SUMMARY OF THE INVENTION

According to this invention, a coupled cavity travelling wave tube is provided wherein the interaction gap in one cavity is displaced with reference to the transverse central plane of its cavity towards the input end of the slow wave structure and the interaction gap in a succeeding cavity is displaced with reference to the transverse central plane of that cavity in the direction of the output end of said slow wave structure.

Normally said slow wave structure comprises a plurality of greater than two coupled cavities and the interaction gaps of successive cavities are displaced alternately towards the input end of said slow wave structure and towards the output end of said slow wave structure.

Where each cavity is defined by a partition wall separating that cavity from a successive cavity, a beam hole is provided within each partition wall in the path of an electron beam passing axially through said slow wave structure and said interaction gaps are defined by the ends of drift tubes carried by said partition walls and surrounding the beam holes therein, the displacement of said interaction gaps may be realised by relatively increasing the axial lengths of the drift tubes carried by alternate ones of said partition walls while relatively reducing the axial lengths of the drift tubes carried by the remaining ones of said partition walls.

Preferably where each cavity is defined by a partition wall separating that cavity from a successive cavity and a beam hole is provided within each partition wall in the path of an electron beam passing axially through said slow wave structure, alternate ones of said partition walls each carries a drift tube surrounding the coupling hole in said partition and extending into the cavities on either side of said partition, and the remaining partitions carry no drift tubes surrounding the beam holes therein.

DESCRIPTION OF THE PREFERRED EMBODIMENT

Figure 3:
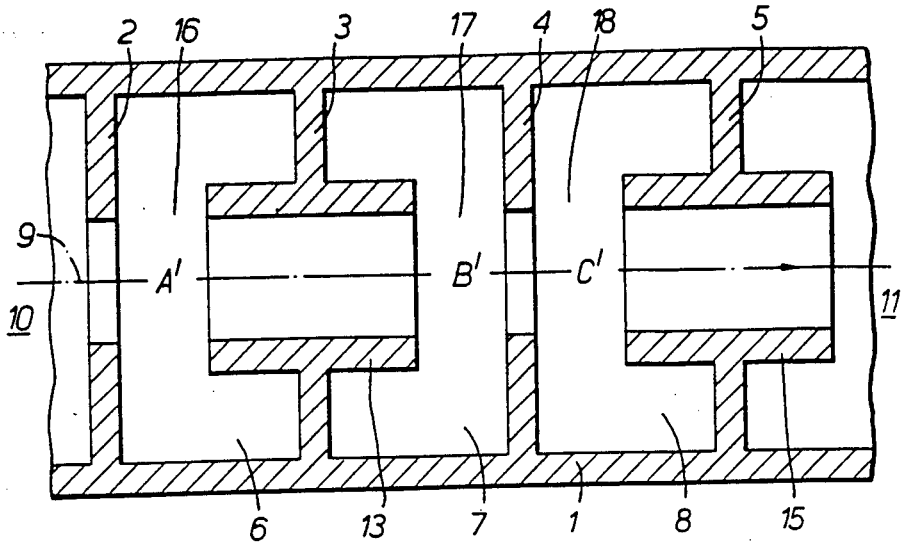
FIG. 3 is a longitudinal section through the slow wave structure of a coupled cavity travelling wave tube of the present invention.
Figure 4:
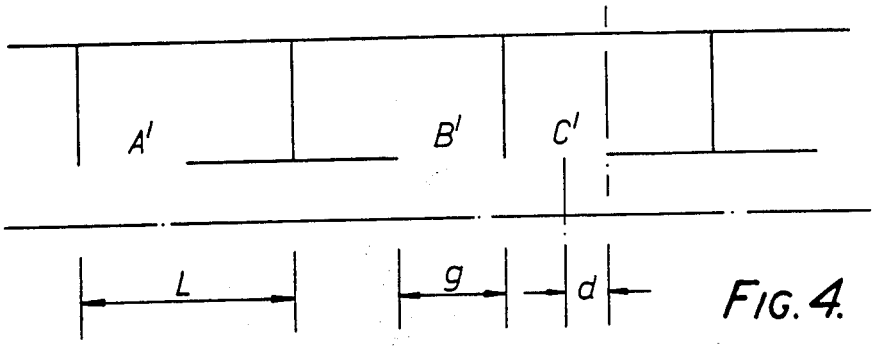
FIGS. 4, 5*a* and 5*b* are diagrams for explaining the operation of the travelling wave tube of FIG. 3.
Figure 5A:
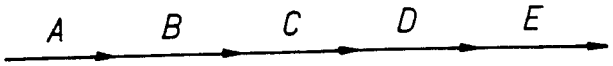
Figure 5B:
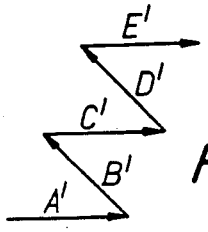

The invention is further described with reference to FIGS. 3, 4, 5*a* and 5*b* of the accompanying drawings in which FIG. 3 shows a longitudinal section through the slow wave structure of one example of a coupled cavity travelling wave tube in accordance with the present invention and FIGS. 4, 5*a* and 5*b* are explanatory diagrams. Like references in FIG. 3 are used for like parts in FIG. 1.

Figure 1:
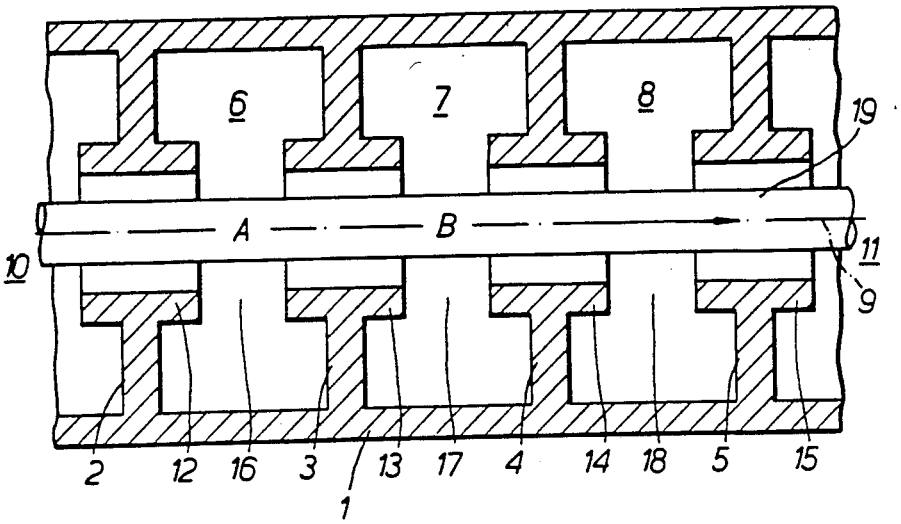
FIG. 1. PRIOR ART
FIG. 1 is a longitudinal section through the slow wave structure of a conventional coupled cavity travelling wave tube.

Referring to FIG. 3 the principle difference between the slow wave structure here shown and the slow wave structure shown in FIG. 1 is that the interaction gaps such as 16, 17 and 18 are offset with reference to the transverse central planes of their respective cavities 6, 7 and 8 alternately towards the input and towards the output in successive cavities. Thus interaction gap 16 is offset within its cavity towards the input end 10 of the slow wave structure; the next interaction gap 17 in succession is offset within its cavity 7 towards the output end 11 of the slow wave structure; the next interaction gap 18 in succession is offset within its cavity 8 towards the input end 10 of the slow wave structure . . . and so forth. In this particular case alternate ones of the drift tubes (e.g. those referenced 12 and 14 in FIG. 1) are dispensed with while the remaining drift tubes (e.g. 13, 15) are increased in axial length symmetrically about the partition walls from which they extend. The mid-points of the interaction gaps 16, 17 and 18 are referenced A′, B′ and C′ respectively.

For an explanation as to why such a measure has a tendency to reduce oscillation at the band edge, it is convenient to refer to the idealised form of the structure illustrated in FIG. 4. Consider first an electron which is synchronous with the electro-magnetic wave at a phase shift of 270° per cavity. In the uniform structure of FIG. 1 this electron encounters the same phase of the field as it crosses each interaction gap. In the offset structure the field perceived by the electron at the center B′ of the interaction gap 17 is advanced in phase by 135° with respect to that at the mid-point A′ of the interaction gap 16. The field at the mid-point C′ of the interaction gap 18 is in phase with that at the mid-point A′ of interaction gap 16 . . . and so on.

Figure 2:
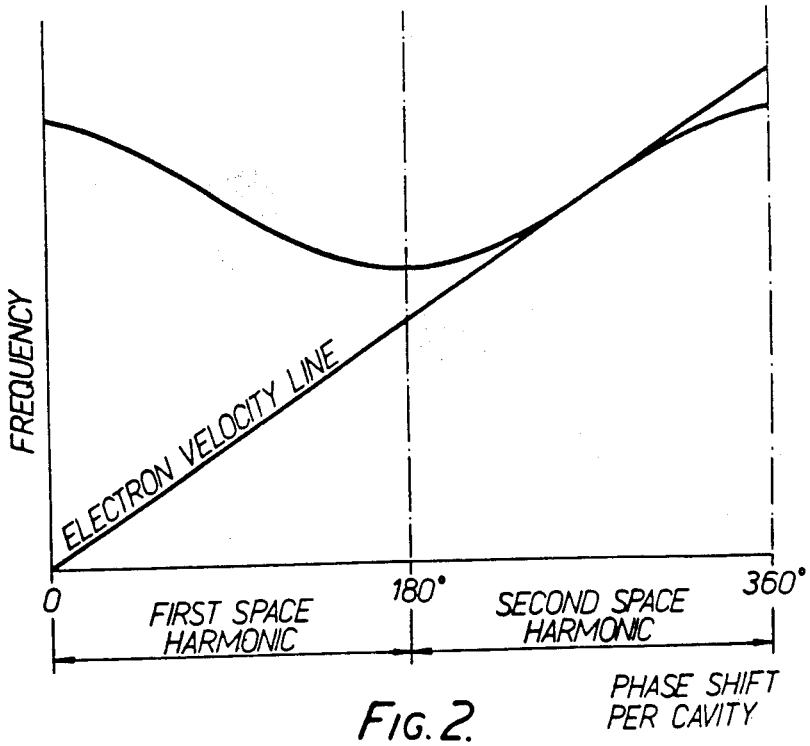
FIG. 2 is a dispersion diagram for the travelling wave tube of FIG. 1 in which frequency is plotted against phase shift per cavity.

The two different situations of the structure illustrated by FIG. 1 and the structure illustrated by FIG. 2 are represented by phasor diagrams in FIG. 5*a* and 5*b* where FIG. 5*a* shows the cumulative effect of the cavity fields in a uniform structure as shown in FIG. 1 and FIG. 5*b* shows the change in an offset structure as shown in FIG. 3. The strength of the interaction is reduced by offsetting the interaction gaps but it is still significant and generally regarded as sufficient.

An electron beam which is synchronous with the electro-magnetic wave at the band edge encounters the same phase of field in every cavity in a uniform structure of the kind illustrated in FIG. 1, but in the offset structure as illustrated in FIG. 3 the phase at the mid point B′ of the interaction gap 17 differs from that at the mid point A′ of the interaction gap 16 by 180° while that at the mid point C′ of interaction gap 18 is in phase with that at the midpoint A′ of interaction gap 16. Thus in the offset structure as illustrated in FIG. 3 an electron which is synchronous at the band edge experiences a phase reversal at each successive interaction gap so that there is, theoretically, no net force upon it. In this way the interaction at the band edge may be significantly reduced without the tube being prevented from amplifying at the band center.

In practice it would not be possible for the structure to assume the idealised form shown in FIG. 4. The strength of the space harmonic components of the interaction field can be found by Fourier analysis so that $$2LE_n = \int_{z_1}^{z_2} E_o e^{j\beta_n z} dz + \int_{z_3}^{z_4} E_o e^{-j\phi} e^{j\beta_n z} dz$$

where $E_n$ is the amplitude of the space harmonic field, $E_o$ the amplitude of the field in the cavities, $\phi$ is the phase shift between the cavities and the integrations are carried out over the two interaction gaps of each offset pair. The result of the analysis is $$\frac{E_n}{E_o} = \frac{\sin\beta_n g/2}{\beta_n L/2} e^{j\beta_o L/2} \cos(\beta_n d - n\pi)$$

where L is the cavity pitch, g the width of each interaction gap, and d the offset between the centers of the gaps and the centers of the cavities. For the space harmonic of interest $n=1$ and $\beta_n=\beta_o+2n\pi/L$. At the band edge $\beta_n=2\pi/L$ so $E_n$ can be reduced to zero by setting $d=L/4$ which agrees with the qualitative analysis given above. For smaller amounts of offset $E_n$ is not zero at the band edge but it is still reduced more strongly than the field at the band center.

I claim:

1. A coupled cavity travelling wave tube having a slow wave structure comprising a plurality of greater than two coupled cavities and wherein the intersection gaps of successive cavities are displaced, with reference to the transverse central plane of the respective cavity, alternately towards the input end of said slow wave structure and towards the output end of said slow wave structure.

2. A tube as claimed in claim 1 wherein each cavity is defined by a partition wall separating that cavity from a successive cavity, a beam hole is provided within each partition wall in the path of an electron beam passing axially through said slow wave structure and said interaction gaps are defined by the ends of drift tubes carried by said partition walls and surround the beam holes therein and wherein the displacement of said interaction gaps is realized by relatively increasing the axial lengths of the drift tubes carried by alternate ones of said partition walls while relatively reducing the axial lengths of the drift tubes carried by the remaining ones of said partition walls.

3. A tube as claimed in claim 2 and wherein alternate ones of said partition walls each carries a drift tube surrounding the coupling hole in said partition and extending into the cavities on either side of said partition, and the remaining partitions carry no drift tubes surrounding the beam holes therein.

4. A slow wave structure for a coupled cavity travelling wave tube, comprising a cylindrical outer tube having a longitudinal axis; and first and second alternating sets of partitions positioned within said outer tube, the partitions of said first set being interposed between the partitions of said second set and spaced therefrom along said longitudinal axis, each of said partitions having a drift tube portion of the same diameter surrounding a beam hole in the partition, the drift tube portions of said first set of partitions having a greater length along said longitudinal axis than the drift tube portions of said second set of partitions.

* * * * *